United States Patent [19]

Demoulin et al.

[11] Patent Number: 4,647,112

[45] Date of Patent: Mar. 3, 1987

[54] ROTARY CUTTER FOR GOUGING OUT ORE FROM MINE FACES

[75] Inventors: Jean Demoulin, Ippling, France; Walter Hemmer, Neunkirchen; Reinhard Schiel, Landstuhl, both of Fed. Rep. of Germany

[73] Assignee: Charbonnages de France, Paris, France

[21] Appl. No.: 722,737

[22] Filed: Apr. 12, 1984

[30] Foreign Application Priority Data

Apr. 14, 1984 [DE] Fed. Rep. of Germany ..... 3414195

[51] Int. Cl.[4] ..... E21C 35/22; E21F 5/02

[52] U.S. Cl. ..... 299/81; 299/79; 299/89

[58] Field of Search ..... 299/89, 79, 81, 16, 299/17; 175/67, 393; 299/75, 76, 78, 85

[56] References Cited

U.S. PATENT DOCUMENTS

| | | | |
|---|---|---|---|
| 3,374,033 | 3/1968 | Arentzen | 299/81 |
| 3,747,982 | 7/1973 | Agnew et al. | 299/81 |
| 3,834,763 | 9/1974 | Sigott | 299/85 |
| 4,098,539 | 7/1978 | Zitz et al. | 299/89 X |
| 4,285,549 | 8/1981 | Zitz et al. | 299/81 X |
| 4,389,075 | 6/1983 | Kogler | 299/89 X |
| 4,516,807 | 5/1985 | Eagles | 299/81 X |

FOREIGN PATENT DOCUMENTS

| | | | |
|---|---|---|---|
| 2653706 | 6/1978 | Fed. Rep. of Germany | 299/81 |
| 2045837 | 11/1980 | United Kingdom | 299/81 |
| 2070104 | 9/1981 | United Kingdom | 299/85 |

*Primary Examiner*—Stephen J. Novosad
*Assistant Examiner*—Michael A. Goodwin
*Attorney, Agent, or Firm*—Peter K. Kontler

[57] ABSTRACT

The rotor of a cutter for removal of material from a mine face has a large number of externally mounted bits each of which is adjacent to a discrete spray nozzle serving to discharge one or more streams of water at a pressure in the range of several thousand bars. The nozzles receive water from conduits which are installed in an annular chamber between the skirt of the substantially cup-shaped rotor and the adjacent end portion of the drive shaft for the rotor. Groups of conduits receive pressurized water from manifolds which are installed in the chamber and each such manifold receives pressurized water from a discrete conduit which, in turn, receives pressurized water from a distributor rotating at the discharge end of a stationary pipe in an axial bore of the shaft.

22 Claims, 5 Drawing Figures

ROTARY CUTTER FOR GOUGING OUT ORE FROM MINE FACES

BACKGROUND OF THE INVENTION

The present invention relates to material removing devices in general, and more particularly to improvements in rotary cutters for gouging out materials from mine faces or the like. Still more particularly, the invention relates to improvements in rotary cutters which can be used in so-called advance working machines for tunneling holes in mine faces in order to remove or to facilitate the removal of rock, ore or other solid matter.

U.S. Pat. No. 4,244,626 to Konieczny et al. discloses a rotary cutter which has a rotor carrying a number of material removing bits and being installed at one end of a driven shaft. The rotor further carries a set of spray nozzles which discharge streamlets of water to cool the bits as well as to extinguish sparks which develop as a result of penetration of bits into the material of the mine face, e.g., in an underground excavation. The nozzles receive water from cavities which are machined into the rotor.

It was further proposed to use the sprays of water which issue from the orifices of the nozzles as a means for removing the comminuted material (such as rock or ore) from the mine face. This renders it necessary to raise the pressure of water in order to ensure that the sprays will be capable of removing large quantities of comminuted material. Presently known cutters which utilize nozzles serving to facilitate or promote the removal of material from the mine face supply water at a pressure in the range of several hundred bars. Such pressure does not invariably suffice to ensure the removal of adequate quantities of comminuted material. Moreover, presently known liquid supplying systems are prone to malfunction, their parts are not readily accessible and they occupy too much space in the cutters.

OBJECTS AND SUMMARY OF THE INVENTION

An object of the invention is to provide a rotary cutter which can be used for removal of material from the mine face in a surface mine or in an underground excavation and is constructed and assembled in such a way that its nozzles can receive water or another liquid at a pressure greatly exceeding the pressure at which the liquid can be supplied to the nozzles of conventional cutters.

Another object of the invention is to provide a rotary cutter with a novel and improved liquid supplying system and to construct the liquid supplying system in such a way that its parts are readily accessible for inspection, replacement or repair and that its parts can be assembled in a small space to allow for the making of a compact and lightweight cutter.

A further object of the invention is to provide a rotary cutter which can supply water or another liquid at a pressure several times the pressure achievable in conventional cutters.

An additional object of the invention is to provide a novel and improved method of supplying streams of highly pressurized liquid from a stationary pipe to a large number of orbiting spray nozzles.

Still another object of the invention is to provide a novel and improved rotary cutter which can be used in existing mining machines as a superior substitute for conventional cutters.

Another object of the invention is to provide a cutter which can be equipped with one or more sets of bits and spray nozzles.

A further object of the invention is to provide a cutter wherein the liquid supplying components are shielded from dust and other foreign matter but are readily accessible in the event of need in a time-saving operation and by utilizing simple and readily available tools.

An additional object of the invention is to provide a novel and improved method of supplying water to a large number of spray nozzles at the exterior of the rotor of a rotary cutter for removal of rock, ore or other materials from mine faces.

The invention is embodied in a rotary cutter which can be used with particular advantage as a means for gouging out ore from mine faces. The improved cutter comprises a shaft having an end portion, a substantially cup-shaped rotor which is mounted on and receives torque from the end portion of the shaft and has an annular skirt surrounding the end portion of the shaft with spacing and defining a chamber with the end portion of the shaft, a plurality of external material removing bits which are provided on the rotor (preferably at the exterior of the skirt), a plurality of external spray nozzles which are provided on the rotor (for example, each such nozzle can be adjacent to a discrete bit at the exterior of the skirt), and means for supplying a highly pressurized fluid medium (such as water) to the spray nozzles. The fluid medium supplying means includes conduits which are installed in the chamber between the end portion of the shaft and the skirt of the rotor.

The cutter can comprise a single rotor; the other end portion of the shaft then receives torque from a suitable prime mover (e.g., by way of an additional shaft and a transmission installed in a boom and in a hollow support which surrounds the shaft). Alternatively, the cutter can comprise two substantially cup-shaped rotors, one at each end portion of the shaft. The intermediate portion of the shaft then receives torque by way of a gear or the like and such cutter then further comprises a plurality of external material removing bits on the second rotor, a plurality of second external spray nozzles on the second rotor, and means for supplying a fluid medium to the second nozzles; such fluid medium supplying means comprises conduits which are installed in the chamber surrounding the other end portion of the shaft and being surrounded by the skirt of the second rotor. Such cutter preferably further comprises means for preventing the admission of fluid medium to the second nozzles when the other nozzles receive fluid medium and vice versa.

The skirt of each rotor preferably extends in a direction from the end face of the respective end portion of the shaft toward the other end portion of the shaft. Each rotor preferably further comprises a sleeve which is surrounded by the skirt with spacing and receives torque from the shaft. One end portion of the sleeve can be integral with the respective skirt and the axial length of the sleeve can be a fraction (e.g., one-half) of the axial length of the skirt. Each rotor further comprises a cover which overlies the end face of the respective end portion of the shaft and is rigid with the respective skirt and sleeve. Means is preferably provided for releasably securing each sleeve to the respective end portion of the shaft so that the respective rotor is held against axial movement relative to the shaft.

The shaft has an axial bore and the fluid medium supplying means further comprises a stationary (non-rotatable) pipe which is located in the bore and has a discharge end in the region of one end portion of the shaft (if the cutter comprises a single rotor) or in the region of each end portion of the shaft (if the cutter comprises two discrete rotors at the opposite axial ends of the shaft). Each discharge end of the pipe is surrounded by a distributor (e.g., a muff which is coupled to and rotates with the cover of the respective rotor) which receives fluid medium from the discharge end of the pipe and has a plurality of outlets for the fluid medium. The aforementioned conduits include a first set of conduits having intake ends receiving fluid medium from discrete outlets of the distributor. Each fluid medium supplying means further comprises a plurality of manifolds which are installed in the respective chamber and each of the aforementioned first set of conduits serves to deliver fluid medium to a discrete manifold. Each manifold has a plurality of outlets and the conduit means includes a set of additional conduits for each manifold. Each such additional conduit serves to convey fluid medium from a discrete outlet of the respective manifold to one of the nozzles on the respective rotor.

Each discharge end of the pipe is preferably provided with a radially extending fluid-discharging aperture (such aperture can constitute an arcuate slot extending circumferentially of the pipe) and the respective distributor has an annulus of radially extending bores at least one of which communicates with the aperture in the respective discharge end of the pipe in each angular position of the corresponding distributor. Each outlet of each distributor can constitute a bore which is provided in an end face of the distributor and is parallel to the axis of the shaft and communicates with a discrete radially extending bore of the respective distributor. The conduits of the first set can extend through holes which are provided therefor in the sleeve of the respective rotor.

Alternatively, the cover of each rotor can be formed with first channels which form part of the respective fluid medium supplying means and serve to receive fluid medium from discrete outlets of the respective distributor. The sleeve of the respective rotor is then provided with additional channels each of which receives fluid medium from a discrete channel in the cover and each of which delivers pressurized fluid medium to the corresponding conduit of the first set. Sealing elements can be interposed between the cover and the distributor in the regions where the outlets of the distributor communicate with the channels of the cover and/or between the cover and the sleeve in the regions where the channels of the cover deliver fluid medium to the corresponding channels in the sleeve.

The skirt of each rotor is preferably provided with seats for the spray nozzles, and the conduits which deliver pressurized fluid medium from the outlets of the manifolds to the respective nozzles extend through holes which are provided therefor in the skirt. The discharge ends of such conduits are or can be connected directly to the respective nozzles.

The novel features which are considered as characteristic of the invention are set forth in particular in the appended claims. The improved rotary cutter itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
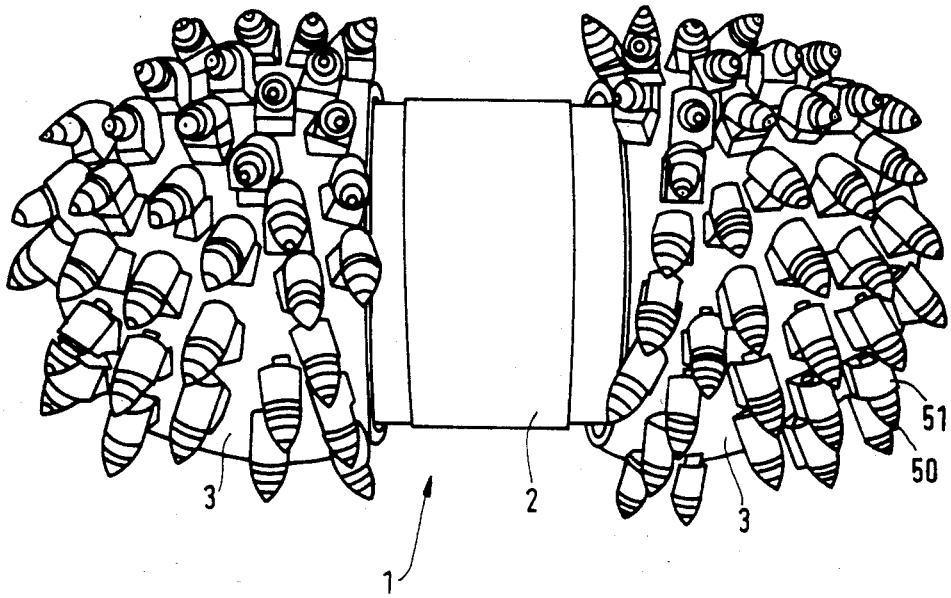
FIG. 1 is a front elevational view of a rotary cutter with two rotors each of which embodies one form of the invention.

FIG. 1 shows a rotary cutter 1 with two rotors 3. The cutter 1 is mounted on the boom of an advance working machine and is movable up and down as well as to the left and to the right, as viewed in FIG. 1, so as to cause the bits 50 on its rotors 3 to penetrate into the material of the mine face. The boom is assumed to be located behind a hollow support 2 which surrounds the median portion of a shaft 8 (see FIG. 2) serving to transmit torque to the rotors 3. The boom includes an additional shaft which, in turn, transmits torque to the shaft 8 for the two rotors 3.

Figure 2:
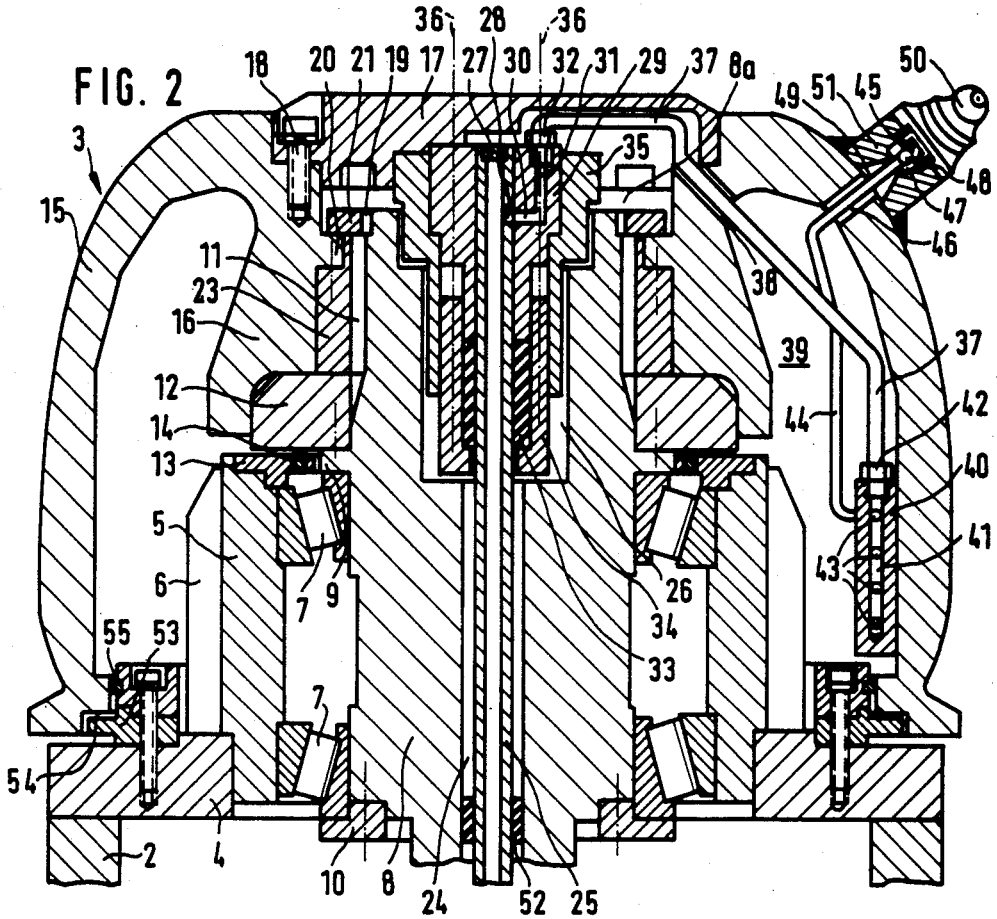
FIG. 2 is an enlarged axial sectional view of one of the shown in FIG. 1.

FIG. 2 shows a portion of the support 2, a portion of the shaft 8, and one of the rotors 3. That part of the generally tubular support 2 which is shown in FIG. 2 comprises an annular front end wall 4 which supports a tubular bearing member 5 surrounding the shaft 8 with spacing. The external surface of the bearing member 5 is formed with axially parallel reinforcing or stiffening ribs 6 which abut against the front or outer side of the end wall 4. The bearing member 5 surrounds two antifriction bearings 7 with rolling elements whose axes are inclined with reference to the axis of the shaft 8. The inner races of the antifriction bearings 7 surround the adjacent portion of the shaft 8 which is driven by the aforementioned additional shaft in the boom through the medium of a gear which is confined in the support 2 and is located at a level below the structure shown in FIG. 2. The means for locking the shaft 8 against axial movement from the position which is shown in FIG. 2 comprises an external collar 9 on the shaft 8 and a nut 10 which meshes with the adjacent externally threaded portion of the shaft 8. The locking collar 9 overlies the inner race of the upper antifriction bearing 7 and the locking nut 10 underlies the inner race of the lower antifriction bearing 7, as viewed in FIG. 2.

Figure 3:
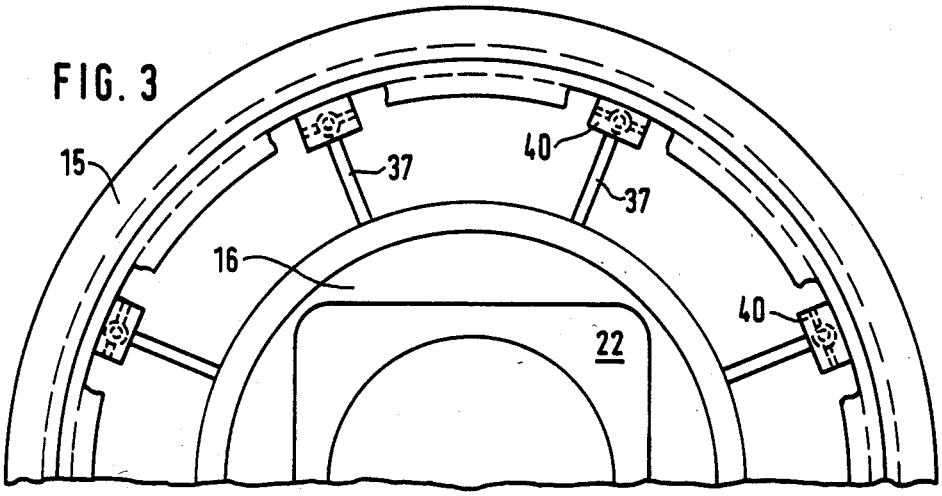
FIG. 3 is a fragmentary bottom plan view of the rotor of FIG. 2.

The shaft 8 comprises an externally splined portion 11 which is disposed between the collar 9 and the end face **8*a* of the shaft and transmits torque to the rotor 3 of FIGS. 2 and 3. An internally threaded seat 12 mates with the adjacent external thread of the shaft 8 and abuts against the collar 9. The seat 12 extends into a complementary recess at one end of a sleeve 16 which forms part of the rotor 3 and the other end of which is integral with an annular skirt 15 also forming a component part of the rotor and extending along the exterior of the shaft 8 in a direction away from the end face 8*a*, i.e., downwardly, as viewed in FIG. 2. The space between the collar 9 and the adjacent end portion of the tubular bearing member 5 includes a ring-shaped seal 14 which surrounds the collar 9 and is urged against the adjacent end face of the seat 12 by a ring 13 which is in mesh with or is otherwise mounted on the end portion of the bearing member 5. The ring-shaped seal 14 prevents the penetration of dust and/or other foreign matter into the space for the antifriction bearings 7; in addition, such seal prevents the flow of fluids and/or solids between the space for the bearings 7 and an annular chamber 39 which surrounds the end portion of the shaft 8 and is surrounded by the skirt 15 of the rotor 3**.

The rotor 3 further comprises a cover or lid 17 which overlies the end face 8*a* of the shaft 8 and is secured to the adjacent integral end portions of the skirt 15 and sleeve 16 by a set of screws 18 or other suitable fasteners. The parts 15 and 17 of the rotor 3 resemble a cup whose bottom wall (17) is adjacent to the end face 8*a* of the shaft 8 and whose tubular portion (skirt 15) surrounds the respective end portion of the shaft 8 with spacing.

The sleeve 16 of the rotor 3 has an internal collar 20 which is adjacent to a polygonal (preferably square) recess 22 (see FIG. 3) of the sleeve 16 and is urged against the adjacent end face of an insert 23 in the recess by a nut 21 mating with the adjacent external thread 19 of the shaft 8. The insert 23 has axially parallel internal keys which extend into the splines 11 of the shaft 8 so that the sleeve 16 is compelled to share all angular movements of the shaft 8 because the outline of the periphery of the insert 23 is complementary to the outline of the surface surrounding the recess 22. The nut 21 urges the collar 20 against the insert 23 which, in turn, is urged against the seat 12.

The just described construction of the rotor 3, shaft 8 and support 2 renders it possible to gain access to the end face 8*a* of the shaft 8 in response to detachment of the cover 17, i.e., in response to removal of the fasteners 18. This is desirable and advantageous because numerous parts of the means for supplying a fluid medium to the external spray nozzles 45 on the skirt 15 of the rotor 3 are disposed at the end face 8*a*. The shaft 8 has an axial bore 24 for a fluid supplying pipe 25 the end portion of which extends into and beyond a cylindrical counterbore 26 in the end face 8*a*. The end portion of the pipe 25 is sealed by a screw cap 27 and the cylindrical wall of the pipe 25 has an aperture in the form of a slot 28 which is spaced apart from the screw cap 27 and extends along an arc of approximately 45 degrees, as considered in the circumferential direction of the pipe 25. The end portion of the pipe 25 is sealingly surrounded by a distributor here shown as a muff 29 which has eight equidistant radially extending blind bores 30 at the level of the slot 28. The bores 30 communicate with additional bores or ports 31 which are machined into the muff 29 and extend in parallelism with the axis of the shaft 8. Each of the bores or ports 31 constitutes a discrete outlet at the upper end face of the muff 29, as viewed in FIG. 2. Each of the outlets 31 is connected to a discrete conduit 37 by a coupling 32.

The smaller-diameter lower portion of the muff 29, as viewed in FIG. 2, is surrounded by a cylinder 34 forming part of a stuffing box which further includes a packing 33 sealingly surrounding the adjacent portion of the pipe 25. The upper portions of the cylinder 34 and muff 29, as viewed in FIG. 2, are surrounded by a shell 35. Screws 36 (indicated in FIG. 2 by phantom lines) are provided to pull the cylinder 34 upwardly so that its annular bottom wall urges the packing 33 against the adjacent end face of the muff 29 to thus prevent leakage of the fluid medium (normally water) from the slot 28, along the external surface of the stationary pipe 25, and into the axial bore 24 of the shaft 8. The screws 36 further serve to secure the muff 29 and the cylinder 34 to the cover 17 of the rotor 3, i.e., the parts 29, 34 and 35 rotate with the parts 15, 16 and 17 of the rotor 3 relative to the pipe 25.

The conduits 37 extend from the corresponding outlets 31 of the muff 29 and radially of the shell 35 through cutouts which are provided therefor in the underside of the cover 17. Such conduits further extend through inclined holes 38 of the sleeve 16 and into the adjacent portions of the chamber 39 between the skirt 15 and the shaft 8. The discharge end of each of the eight conduits 37 is connected to the inlet of one of eight discrete elongated strip- or block-shaped manifolds 40 which are installed on the skirt 15 in the chamber 39 and each of which has an axially extending channel 41 with two rows of four outlets 43 each. The reference character 42 denotes in FIG. 2 a coupling which sealingly connects the illustrated conduit 37 to the respective manifold 40 so that the fluid medium which flows from the pipe 25 via corresponding outlet 31 can enter the channel 41 of the manifold 40. The illustrated outlets 43 are spaced apart from each other, as considered in the longitudinal direction of the respective channel 41, and each maniold further comprises a row of four additional outlets 43 located in front of the illustrated row. Each of these outlets is connected with the inlet of a discrete conduit 44 which serves to convey a stream of fluid medium to the corresponding spray nozzle 45 at the exterior of the skirt 15. The manner in which the conduits 44 are connected with the respective manifolds 40 and the respective spray nozzles 45 can be the same as disclosed in the commonly owned copending patent application Ser. No. 722,738 filed Apr. 12, 1985 by Jean Demoulin et al.

The number of conduits 37 can be reduced to seven or less or increased to nine or more, and the number of conduits 44 can be reduced to less than eight or increased to nine or more. The rotor 3 of FIGS. 2 and 3 has eight conduits 37 and eight conduits 44 for each conduit 37 because the skirt 15 is assumed to carry a total of sixty four external spray nozzles 45, one for each of the externally mounted bits 50 on the skirt 15. Each of the eight manifolds 40 supplies streams of fluid medium to the nearest spray nozzles 45 at the exterior of the skirt 15, i.e., to one-eighth of the total number of spray nozzles. It is also possible to construct the fluid medium supplying means in such a way that certain manifolds supply the fluid medium to a first number of nozzles and each of the remaining manifolds supplies fluid medium to a different second number of nozzles. Also, the length of the arcuate slot 28, as considered in the circumferential direction of the pipe 25, can be increased to more or reduced to less than 45 degrees, depending on the number of outlets 31 and conduits 37. Each of the outlets 31 receives fluid medium during a certain portion of each revolution of the muff 29 and rotor 3 relative to the pipe 25.

The conduits 37 and 44 are installed in the interior of the rotor 3 before the cover 17 is secured to the sleeve 16 and skirt 15 by the fasteners 18 and before the nut 21 is applied to secure the rotor to the shaft 8. The manifolds 40 are preferably installed in the chamber 39 close to the open end of the skirt 15 because this facilitates the installation of conduits 44 and 37 in the chamber 39 which is sufficiently large to allow for convenient access to each of the conduits 37 and 44 as well as to the manifolds 40. The discharge ends of the conduits 44 extend through discrete holes 46 in the skirt 15 and extend into the sockets 47 for the respective spray nozzles 45. Each socket 47 contains a spherical joint 48 for the respective nozzle 45 and for the discharge end of the respective conduit 44. It has been found that the just described manner of mounting the conduits 44 (between the nearest manifolds 40 and the respective holes 46) allows for time-saving assembly of the rotor 3 and of the rotary parts of the fluid supplying means without it being necessary to unduly enlarge the chamber 39, i.e., to unduly increase the dimensions of the rotor 3 or to unduly reduce the thickness of its parts. The nozzles 45 are threadedly connected with the discharge ends of the respective conduits 44. Thus, all that is necessary is to introduce the discharge end of a conduit 44 into the respective socket 47 by way of the hole 46 so that the externally threaded tip of the discharge end is ready to be threadedly connected with a nozzle 45. The nozzle 45 is then pushed into the corresponding socket 47 so that the internally threaded portion of the nozzle sealingly engages the socket. The spherical joint 48 then allows for necessary adjustments in the orientation of the attached nozzle 45. Once the orientation of the nozzle 45 is completed, the joint 48 is fixed in the selected position by a screw or the like. A conical space 49 is inwardly adjacent to the socket 47 for the nozzle 45 and enables the corresponding portion of the conduit 44 to change its inclination so as to ensure that the nozzle 45 sprays the fluid medium in the desired direction, i.e., that the spherical joint 48 has sufficient freedom of movement for proper orientation of the orifice or orifices of the nozzle. The socket 47 for the nozzle 45 is provided in the holder 51 for the corresponding material removing bit 50.

FIG. 2 further shows an annular seal 52 which is installed in the bore 24 and sealingly surrounds the pipe 25 at the level of the locking nut 10. A ring 53 is threadedly connected to the annular end wall 4 of the support 2 and defines with the adjacent open end of the skirt 15 a labyrinth seal 54. An annular seal 55 can be installed in or adjacent to the labyrinth seal 54 in order to further reduce the likelihood of penetration of foreign matter into the chamber 39.

The manner in which the bits 51 remove material from the mine face in an underground excavation can be the same as disclosed in the aforementioned U.S. Pat. No. 4,244,626 to Konieczny et al. It will be noted that the means for supplying water or another fluid medium to the nozzles 45 consists of conduits (namely the pipe 25 and parts 37, 44) and equivalent bores, channels and/or ports 30, 31 and 41.

The axial length of the sleeve 16 is a fraction of the axial length of the skirt 15. For example, the axial length of the sleeve 16 can equal or approximate half the axial length of the skirt 15. The parts 12, 21 and 23 can be said to constitute a means for securing the sleeve 16 to the shaft 8 in such a way that the rotor 3 is held against axial movement relative to the shaft.

The cutter 1 of FIG. 1 with two mirror symmetrical rotors constitutes a presently preferred embodiment of the invention. However, it is equally possible to omit one of the rotors and to connect the respective end portion of the shaft 8 directly or indirectly with a suitable prime mover, not shown. The means for pressurizing the fluid medium which is delivered into the pipe 25 is of conventional design and its exact construction forms no part of the invention.

As can be seen in each of FIGS. 1 and 2, each of the substantially cup-shaped rotors 3 has a smaller-diameter front end portion (in the region of the respective cover 17) and a second or rear portion whose diameter increases to a level approximately at the open end of the respective sleeve 16 and then decreases gradually toward the open rear end of the respective skirt 15. It has been found that such design is surprisingly satisfactory not only as concerns the ability of the cutter to take up substantial stresses but also as concerns the transmission of forces from and to the bits 50. Moreover, such design renders it possible to provide relatively large chambers 39 which can accommodate substantial numbers of manifolds and conduits and each of which is readily accessible upon detachment of the respective cover 17. The chambers 39 are large enough to permit installation of individual conduits for each of the nozzles 45 so as to render it possible to supply the fluid medium at a pressure which is several times the presently permissible maximum pressure. Heretofore, the rotor was provided with welded-in partitions in order to establish a plurality of compartments each of which was in communication with a number of nozzles. The utilization of discrete conduits 44 for the nozzles 45 renders it possible to greatly increase the pressure of the supplied fluid medium.

The feature that each of the rotors 3 comprises an internal sleeve 16 which is integral with the respective skirt 15 contributes to stability of the rotors in spite of the fact that the walls of the skirts are relatively thin. This renders it possible to provide relatively large chambers 39 for a plurality of conduits and manifolds as well as to ensure that each conduit and each manifold is readily accessible for inspection, repair or replacement. It was also found that the torque-transmitting connection between the shaft 8 and the sleeve 16 is sufficiently reliable even if the axial length of the sleeve is much less than (e.g., approximately one-half of) the axial length of the skirt 15. Moreover, it suffices to provide a single integral connection between the sleeve 16 and the respective skirt 15 without adversely affecting the stability of the rotor.

The improved fluid medium supplying means occupies little room, is readily accessible upon detachment of the cover 17 from the parts 15, 16 of the respective rotor 3, and the installation of such fluid medium supplying means with a large number of conduits does not entail undue weakening of the shaft 8, of the respective rotor 3 and/or of the means for transmitting torque between the shaft and the rotor. The cover 17 shields the adjacent component parts of the fluid medium supplying means when the cutter is in actual use but allows for rapid and convenient access to such parts if and when the need arises.

The cutter of FIGS. 1 to 3 is preferably further provided with suitable valve means or the like (not specifically shown) which insures that the fluid medium supplying means for the nozzles 45 on the skirt 15 of one of the rotors 3 receives pressurized fluid medium when the nozzles on the skirt of the other rotor do not receive pressurized fluid medium and vice versa. The arrangement is preferably such that the nozzles 45 of the rotor which is in the process of penetrating into a mine face receive pressurized fluid while the nozzles of the other rotor are sealed from the source of supply of pressurized fluid. It is also possible to provide a shroud which surrounds the nozzles of the inactive rotor so that it is not necessary to seal certain nozzles from the source when the other nozzles receive pressurized fluid medium and vice versa. The proposal to supply pressurized fluid medium only to the nozzles of the active rotor is preferred at this time because it entails substantial savings in energy and reduces the likelihood of flooding the mine face and the surrounding area with water. Moreover, a shroud which is designed to intercept liquids issuing from nozzles at a pressure of several thousand bars is sturdy, bulky and expensive but is nevertheless subject to extensive wear.

Figure 5:
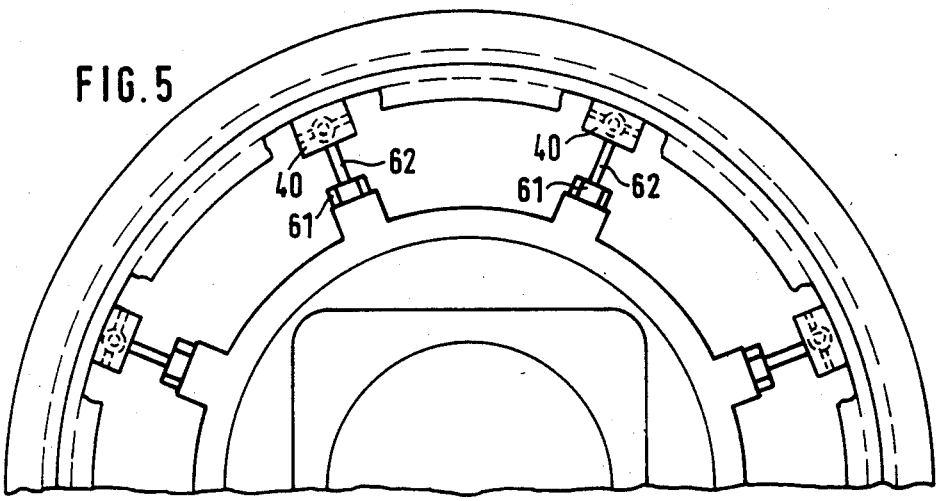
FIG. 5 is a fragmentary bottom plan view of the rotor of FIG. 4.
Figure 4:
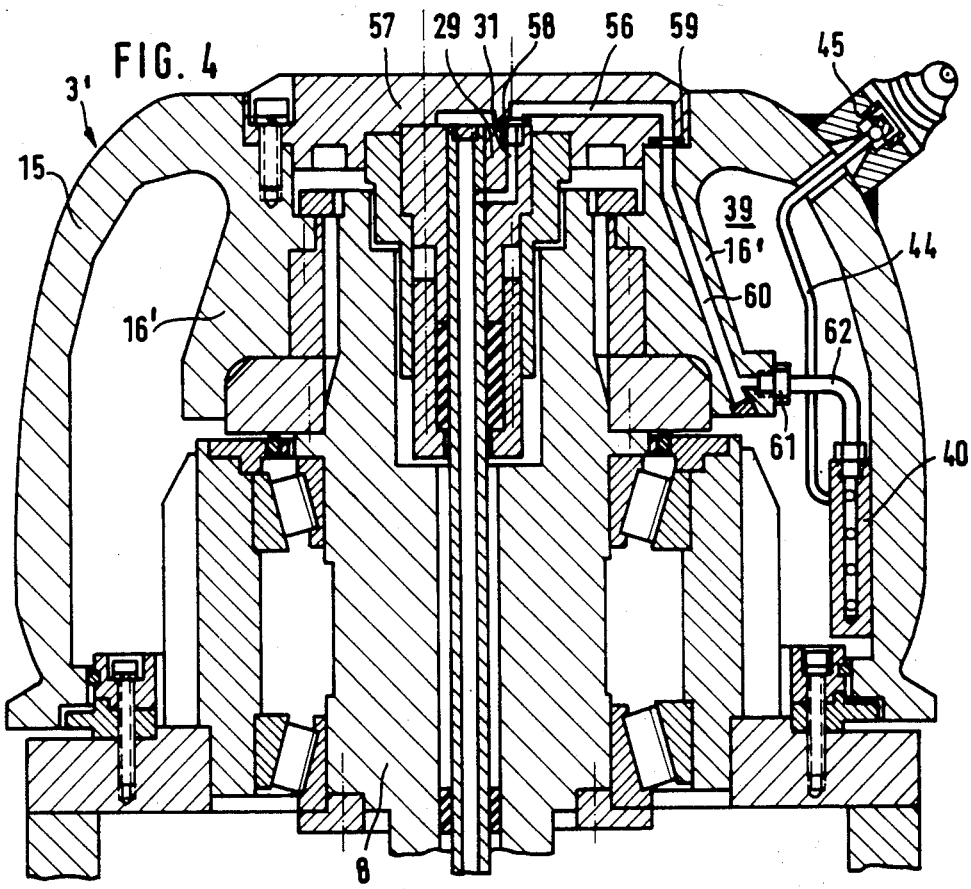
FIG. 4 is an axial sectional view similar to that of FIG. 2 but showing a modified rotor.

The cutter including the rotor 3' of FIGS. 4 and 5 distinguishes from the cutter of FIGS. 2 and 3 in that the conduits 37 of FIGS. 2 and 3 are replaced by much shorter conduits 62. This is accomplished in that the outlets 31 discharge streams of fluid medium into channels or bores 56 which are machined into the cover 57 of the rotor 3'. An annular sealing element 58 is interposed between each outlet 31 and the adjacent inlet of the respective channel 56. The discharge end of each channel 56 communicates with the intake end of a discrete channel 60 which is machined into the adjacent portion of the sleeve 16' and extends toward the inlet of the respective conduit 62. A sealing ring 59 is interposed between the cover 57 and the sleeve 16' in the region of the discharge end of each channel 56 and the inlet of the respective channel 60. The discharge ends of the channels 60 are in communication with the respective conduits 62 by way of suitable couplings 61. The manifolds 40 of FIGS. 4 and 5 can be identical with the manifolds which are shown in FIGS. 2 and 3.

It has been found that the improved fluid supplying system is capable of supplying water or another liquid medium at pressures of up to and even in excess of 2,100 bars.

Each of the two illustrated embodiments of the improved cutter exhibits its own important advantages. The embodiment which is shown in FIGS. 2 and 3 is more complex because the conduits 37 must be led through the recesses of the cover 17 and through the holes 38 of the sleeve 16. The embodiment of FIGS. 4 and 5 is simpler and occupies less space because the conduits 62 of the first set are short and occupy less room in the chamber 39. The conduits 62 can be omitted altogether if the manifolds 40 are mounted directly on the sleeve 16' so that they can receive fluid medium directly from the respective channels 60. It is presently preferred to mount the manifolds 40 at the inner side of the skirt 15 because they are more readily accessible, especially if they are located close to the open end of the skirt.

The mounting of nozzles 45 directly on the discharge ends of the respective conduits 44 also exhibits a number of important advantages. Thus, the number of connections is reduced because there is no need to connect the discharge ends of the conduits 44 to the respective sockets 47 or joints 48 and to connect the nozzles 45 to the respective sockets and/or joints. Each coupling is a weak point in a system which serves to convey liquids at an elevated pressure. Such direct mounting of nozzles 45 on the respective conduits 44 is possible due to the provision of holes 46 in the skirt 15 and in view of the possibility of installing in each chamber 39 a discrete conduit 44 for each of the nozzles 45. Moreover, it is not necessary to fill large compartments of the rotor with a highly pressurized fluid medium; the conduits 37, 44 or 62, 44 deliver discrete streams of such medium directly to the respective nozzles so that the interior of the rotor or rotors need not be filled with large bodies of highly pressurized liquid.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. A rotary cutter, particularly for gouging out ore from mine faces, comprising a driven shaft having an end portion; a substantially cup-shaped rotor mounted on and receiving torque from said shaft, said rotor having an annular cup-like skirt surrounding said shaft with spacing and defining a chamber with said shaft, and said skirt having a first end, and a second end spaced from said first end, said skirt being arranged to receive torque from said shaft virtually exclusiviely via said first end, said rotor comprising a sleeve which is surrounded with spacing by said skirt and receives torque from the end portion of said shaft, the end portion of said shaft having an end face and said skirt and said sleeve extending along said shaft in a direction away from said end face, said sleeve having a first end integral with the first end of said skirt, and the first ends of said sleeve and said skirt being adjacent to said end face, said rotor further comprising a cover overlying the end face of said end portion and rigid with the first ends of said sleeve and said skirt; a plurality of external material removing bits provided on said skirt; a plurality of external spray nozzles provided on said skirt; and means for supplying a fluid medium to said nozzles, including supply pipes provided in said chamber.

2. The cutter of claim 1, further comprising a second substantially cup-shaped rotor mounted on and receiving torque from said shaft, said second rotor having a second annular cup-like skirt surrounding said shaft with spacing and defining a second chamber with said shaft, and said second skirt having a first end, and an open second end remote from said first end thereof, said second skirt being arranged to receive torque from said shaft virtually exclusively via said first end of said second skirt; a plurality of second external material removing bits on said second skirt; a plurality of second external spray nozzles on said second skirt; and means for supplying a fluid medium to said second nozzles, including supply pipes provided in said second chamber.

3. The cutter of claim 2, said shaft having a pair of end portions; and wherein each of said rotors is mounted on and receives torque from a respective end portion of said shaft.

4. The cutter of claim 1, wherein the end portion of said shaft has an end face and said skirt extends along said shaft in a direction away from said end face.

5. The cutter of claim 1, further comprising means for releasably securing said sleeve to said shaft so that the rotor is held against axial movement relative to the shaft.

6. The cutter of claim 1, wherein the length of said sleeve is a fraction of the length of said skirt, as considered in the axial direction of said shaft.

7. The cutter of claim 6, wherein the length of said sleeve is approximately half the length of said skirt.

8. The cutter of claim 1, wherein said skirt has sockets for said nozzles and said supply pipes include end portions extending through holes provided therefor in said skirt and into the respective sockets, said nozzles being affixed directly to the end portions of the respective supply pipes.

9. The cutter of claim 1, wherein said sleeve is circumferentially complete.

10. The cutter of claim 1, wherein said second end is open.

11. A rotary cutter, particularly for gouging out ore from mine faces, comprising a driven shaft having an end portion and an axial bore; a substantially cup-shaped rotor mounted on and receiving torque from the end portion of said shaft said rotor having an annular cup-like skirt surrounding said shaft with spacing and defining a chamber with said shaft, and said skirt having a first end, and a second end spaced from said first end, said skirt being arranged to receive torque from said shaft virtually exclusively via said first end; a plurality of external material removing bits provided on said skirt; a plurality of external spray nozzles provided on said skirt; and means for supplying a fluid medium to said nozzles, including supply pipes provided in said chamber, a delivery pipe located in said bore and having a discharge end in the region of the end portion of said shaft, and a distributor rotatable on said delivery pipe with said rotor, said distributor having a plurality of discrete outlets for the fluid medium, and said supply pipes having intake ends receiving fluid medium from the discrete outlets of said distributor.

12. The cutter of claim 11, wherein said supplying means further comprises a plurality of manifolds in said chamber and each of said supply pipes is arranged to deliver fluid medium to one of said manifolds, said supplying means further comprising a set of additional supply pipes for each of said manifolds, each of said additional supply pipes being arranged to convey fluid medium from the respective manifold to a discrete nozzle.

13. The cutter of claim 11, wherein the discharge end of said delivery pipe has a radially extending fluid-discharging aperture and said distributor has an annulus of radially extending bores at least one of which communicates with said aperture in each angular position of said distributor, each outlet of said distributor communicating with a discrete radial bore.

14. The cutter of claim 13, wherein said aperture is an arcuate slot.

15. The cutter of claim 13, wherein said distributor has an end face and said outlets are bores provided in said end face of said distributor.

16. The cutter of claim 13, wherein said rotor further comprises a sleeve disposed in said chamber and rigid with said skirt, said sleeve having holes and said supply pipes extending through the holes of said sleeve.

17. The cutter of claim 16, wherein said fluid supplying means further comprises manifolds provided in said chamber, one for each of said supply pipes and each receiving fluid medium from the respective supply pipe, each of said manifolds having a plurality of outlets, and said fluid supplying means further comprising additional supply pipes each connecting an outlet of one of said manifolds with a discrete nozzle.

18. The cutter of claim 13, wherein said rotor further comprises a cover, and a sleeve surrounded by said skirt with spacing and integral with said skirt, said fluid supplying means further comprising first channels provided in said cover and each communicating with a distance outlet of said distributor, and second channels provided in said sleeve and each receiving fluid medium from a discrete channel of said cover, said supply pipes being arranged to receive fluid medium from said second channels.

19. The cutter ot claim 18, further comprising sealing elements interposed between said cover and said sleeve in the regions where said first channels communicate with the respective second channels.

20. The cutter of claim 18, further comprising sealing elements interposed between said distributor and said cover in the regions where said first channels communicate with the respective outlets of said distributor.

21. A rotary cutter, particularly for gouging out ore from mine faces, comprising a driven shaft having an end portion and an axial bore; a substantially cup-shaped rotor mounted on and receiving torque from the end portion of said shaft, said rotor having an annular cup-like skirt surrounding said shaft with spacing and defining a chamber with said shaft, and said skirt having a first end, and a second end spaced from said first end, said skirt being arranged to receive torque from said shaft virtually exclusively via said first end; a plurality of external material removing bits provided on said skirt; a plurality of external spray nozzles provided on said skirt; and means for supplying a fluid medium to said nozzles, including supply pipes provided in said chamber and a delivery pipe located in said axial bore and having a discharge end in the region of the end portion of said shaft, said supplying means also including a distributor arranged to receive fluid medium from said discharge end and said distributor having an end face which is spaced from said discharge end in the axial direction of said shaft and is provided with a plurality of discrete outlets for the fluid medium, said distributor being provided with a plurality of passage each of which extends in substantial parallelism with said shaft and communicates with one of said outlets, and said supply pipes having intake ends receiving fluid medium form the discrete outlets of said distributor.

22. The cutter of claim 21, said discharge end having a radially extending fluid-discharging aperture; and wherein said distributor is rotatable on said delivery pipe with said rotor and is provided with a plurality of radial bores at least one of which communicates with said aperture in each angular position of said distributor, each of said passages communicating with a discrete radial bore.

* * * * *